US009362063B2

(12) United States Patent
Farmer et al.

(10) Patent No.: US 9,362,063 B2
(45) Date of Patent: Jun. 7, 2016

(54) BUS PLUG LOCKOUT DEVICES AND RELATED APPARATUS AND METHODS

(71) Applicant: Eaton Corporation, Cleveland, OH (US)

(72) Inventors: Ralph Wendell Farmer, Malvern, IA (US); Curtis Wayne Farquhar, Shenandoah, IA (US)

(73) Assignee: Eaton Corporation, Cleveland, OH (US)

( * ) Notice: Subject to any disclaimer, the term of this patent is extended or adjusted under 35 U.S.C. 154(b) by 53 days.

(21) Appl. No.: 14/319,559

(22) Filed: Jun. 30, 2014

(65) Prior Publication Data

US 2015/0380878 A1 Dec. 31, 2015

(51) Int. Cl.

| | |
|---|---|
| ***H01H 3/20*** | (2006.01) |
| ***H01R 13/633*** | (2006.01) |
| *H01R 25/16* | (2006.01) |
| *H01R 43/00* | (2006.01) |

(52) U.S. Cl.

CPC ..... *H01H 3/20* (2013.01); *H01R 13/6335* (2013.01); *H01R 25/161* (2013.01); *H01R 43/002* (2013.01)

(58) Field of Classification Search

CPC ..... H01H 31/006
USPC ..... 200/50.11, 17 R, 331; 218/120, 140, 7
See application file for complete search history.

(56) References Cited

U.S. PATENT DOCUMENTS 5,451,730 A * 9/1995 Phillips, Sr. ..... H01H 31/006 200/330
2015/0131210 A1* 5/2015 Cloran ..... H01H 3/38 361/622

* cited by examiner

*Primary Examiner* — Vanessa Girardi
(74) *Attorney, Agent, or Firm* — Myers Bigel & Sibley PA

(57) ABSTRACT

An apparatus for locking out an elevated bus plug includes an elongated member, a lockout device at a distal end portion of the elongated member and an actuator at a proximal end portion of the elongated member. The lockout device includes a housing, a channel in the housing that is sized and configured to receive a handle of the bus plug and a handle engagement mechanism connected to the housing. The handle engagement mechanism is configured to engage a handle of the bus plug that has been received in the channel responsive to actuation of the actuator.

20 Claims, 5 Drawing Sheets

BUS PLUG LOCKOUT DEVICES AND RELATED APPARATUS AND METHODS

BACKGROUND

Electrical power distribution busway systems are often used to distribute electrical power throughout buildings, particularly commercial or industrial type buildings. Generally, the busway includes a number of busway sections which are connected to one another by busway joints. Each busway section includes a housing that encloses conducting busbars.

The machines, lights, tools and other components requiring electricity are provided access to the power conducting busbars at various power tap-off locations disposed along the busway. An opening is typically provided through the housing at each power tap-off location and the conductive material of the busbars is exposed for connection with a bus plug connector. The bus plug generally includes an electrical housing containing one or more breakers and a disconnect switch.

The disconnect switch is often operated by a handle, with the handle movable between a power "on" position and a power "off" or disconnect position. It is desirable to lockout the bus plug when the disconnect switch and the handle are in the power off position to help prevent the power from being turned on accidentally.

The busways are often installed at heights of 10 feet or more off the ground. With such installations, an operator typically uses a lift to access and lockout the bus plug.

SUMMARY

Some embodiments of the present invention are directed to an apparatus for locking out an elevated bus plug. The apparatus includes an elongated member, a lockout device at a distal end portion of the elongated member and an actuator at a proximal end portion of the elongated member. The lockout device includes a housing, a channel in the housing that is sized and configured to receive a handle of the bus plug and a handle engagement mechanism connected to the housing. The handle engagement mechanism is configured to engage a handle of the bus plug that has been received in the channel responsive to actuation of the actuator.

In some embodiments, the elongated member is a first elongated member, and the apparatus further includes a second elongated member that extends between the actuator and the handle engagement mechanism. The handle engagement member may be pivotally connected to the housing and include a lever member and a pin member. The second elongated member may be connected to the lever member. The pin member may extend through an aperture of a handle of the bus plug that has been received in the channel responsive to actuation of the actuator.

In some embodiments, the apparatus includes a locking mechanism at the proximal end portion of the elongated member, with the locking mechanism configured to lock the actuator. The locking mechanism may be configured to lock the actuator such that the handle engagement member remains engaged with a handle of the bus plug that has been received in the channel. The apparatus may have a length such that the actuator and/or the locking mechanism are about 5 feet or less off the ground when the handle engagement member is engaged with a handle of the bus plug that is about 12 feet or more off the ground.

The elongated member may be an electrically insulating elongated member. The elongated member may be a hot stick. The elongated member may have a length of at least about 10 feet.

In some embodiments, the channel is a first channel, and the lockout device further includes a second channel that is differently sized than the first channel. The second channel may be configured to receive a handle of the bus plug, and the handle engagement mechanism may be configured to engage a handle of the bus plug that has been received in the second channel responsive to actuation of the actuator. The lockout device may include an aperture defined in the body. The aperture may be positioned such that the handle engagement mechanism extends through the aperture and through the first channel and the second channel responsive to actuation of the actuator.

Some other embodiments of the present invention are directed to an apparatus for locking out an elevated bus plug. The apparatus includes a lockout device. The lockout device includes a housing, a channel in the housing that is sized and configured to receive a handle of the bus plug and a handle engagement mechanism connected to the housing. The lockout device is configured to connect to a distal end portion of an elongated electrically insulating member. The handle engagement mechanism is configured to engage a handle of the bus plug that has been received in the channel responsive to actuation of an actuator at a proximal end portion of the elongated electrically insulating member.

In some embodiments, the handle engagement member is pivotally connected to the housing and comprises a lever member and a pin member. The pin member may extend through an aperture of a handle of the bus plug that has been received in the channel responsive to actuation of the actuator.

The handle engagement member may be configured to lockingly engage a handle of the bus plug that has been received in the channel responsive to a locking mechanism at the proximal end portion of the elongated electrically insulating member.

In some embodiments, the channel is a first channel, and the lockout device further includes a second channel that is differently sized than the first channel. The second channel may be configured to receive a handle of the bus plug, and the handle engagement mechanism may be configured to engage a handle of the bus plug that has been received in the second channel responsive to actuation of the actuator. The lockout device may include an aperture defined in the body. The aperture may be positioned such that the handle engagement mechanism extends through the aperture and through the first channel and the second channel responsive to actuation of the actuator.

Some other embodiments of the invention are directed to a method for locking out an elevated bus plug. The method includes providing an apparatus. The apparatus includes an elongated member, a lockout device at a distal end of the elongated member and an actuator at a proximal end of the elongated member. The lockout device includes a handle receiving channel and a handle engagement member. The method includes receiving a handle of the bus plug in the channel. The method includes engaging the handle in the channel with the handle engagement member responsive to actuation of the actuator.

In some embodiments, the method includes locking the actuator after engaging the handle to lockout the bus plug. In some embodiments, the elongated member has a length of at least about 10 feet.

DETAILED DESCRIPTION OF EMBODIMENTS OF THE INVENTION

Figure 1:
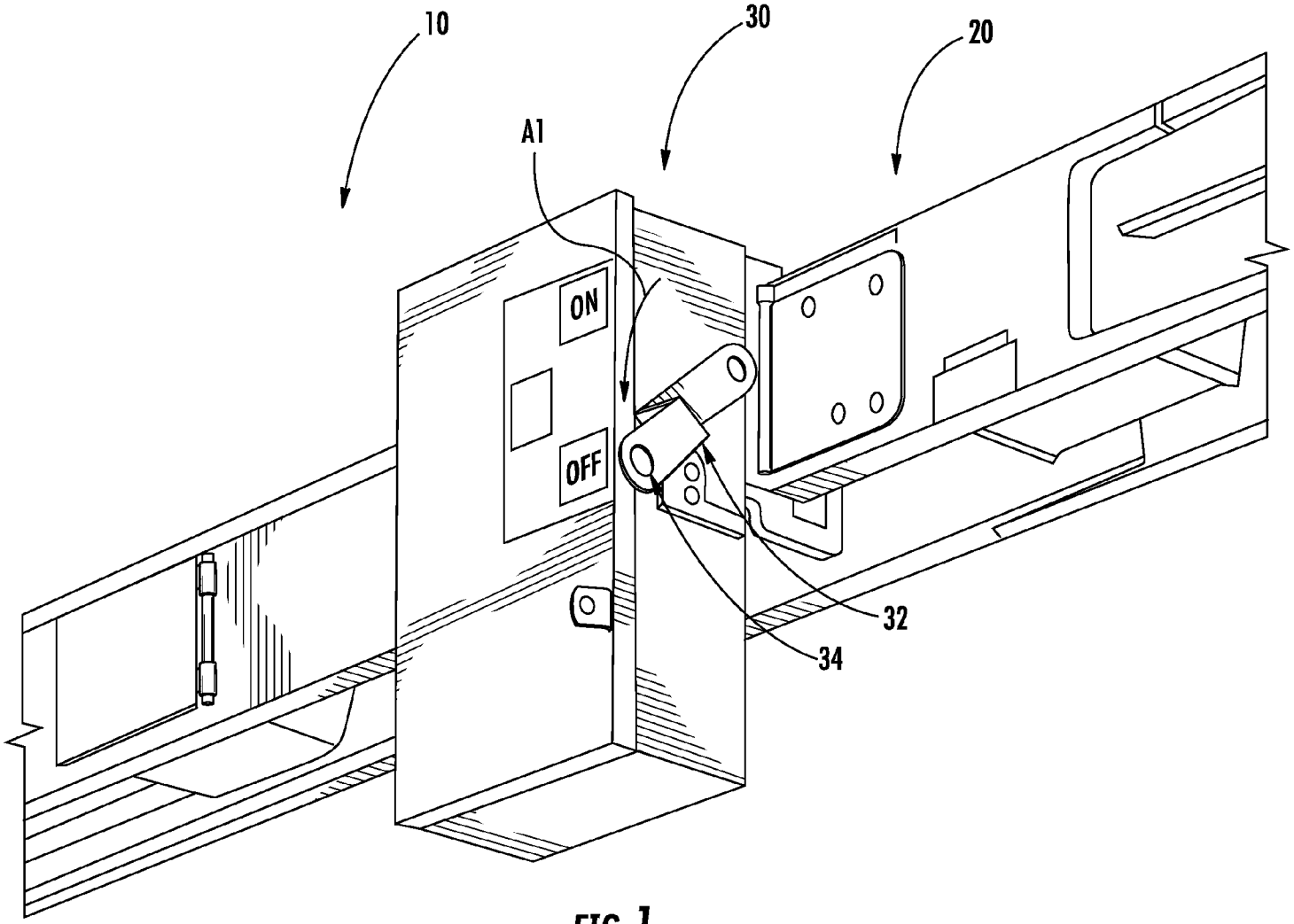
FIG. 1 is a perspective view of a busway system including a bus plug.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is noted that any one or more aspects or features described with respect to one embodiment may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

A busway system 10 is shown in FIG. 1. The busway system 10 includes a busway 20 and a bus plug 30. The bus plug 30 includes a handle 32 that is movable between an "on" position and an "off" position in the direction indicated by the arrow A1. The bus plug 30 may include a disconnect switch that is operated by the handle 32 such that equipment attached to the busway 20 is energized with the handle 32 in the "on" position and de-energized with the handle 32 in the "off" position.

The handle 32 includes an aperture 34. Typically, the handle 32 is manipulated using an insulated hot stick that has a projection or hook that is received in the aperture 34. It is desirable to lockout the bus plug 30 when the handle 32 is in the "off" position (i.e., when the equipment attached to the busway 20 is de-energized). However, many bus plugs are installed on busways that are 10, 12 or 15 feet or more off the ground. In these situations, it is common for one or more operators to use a lift to reach and lockout the bus plug. This introduces work safety hazards associated with using the lift including the risk of falling. This approach also places the operator close to the busway and its associated components and at an increased risk of electrical shock and/or burning from possible electrical arcing.

Figure 2:
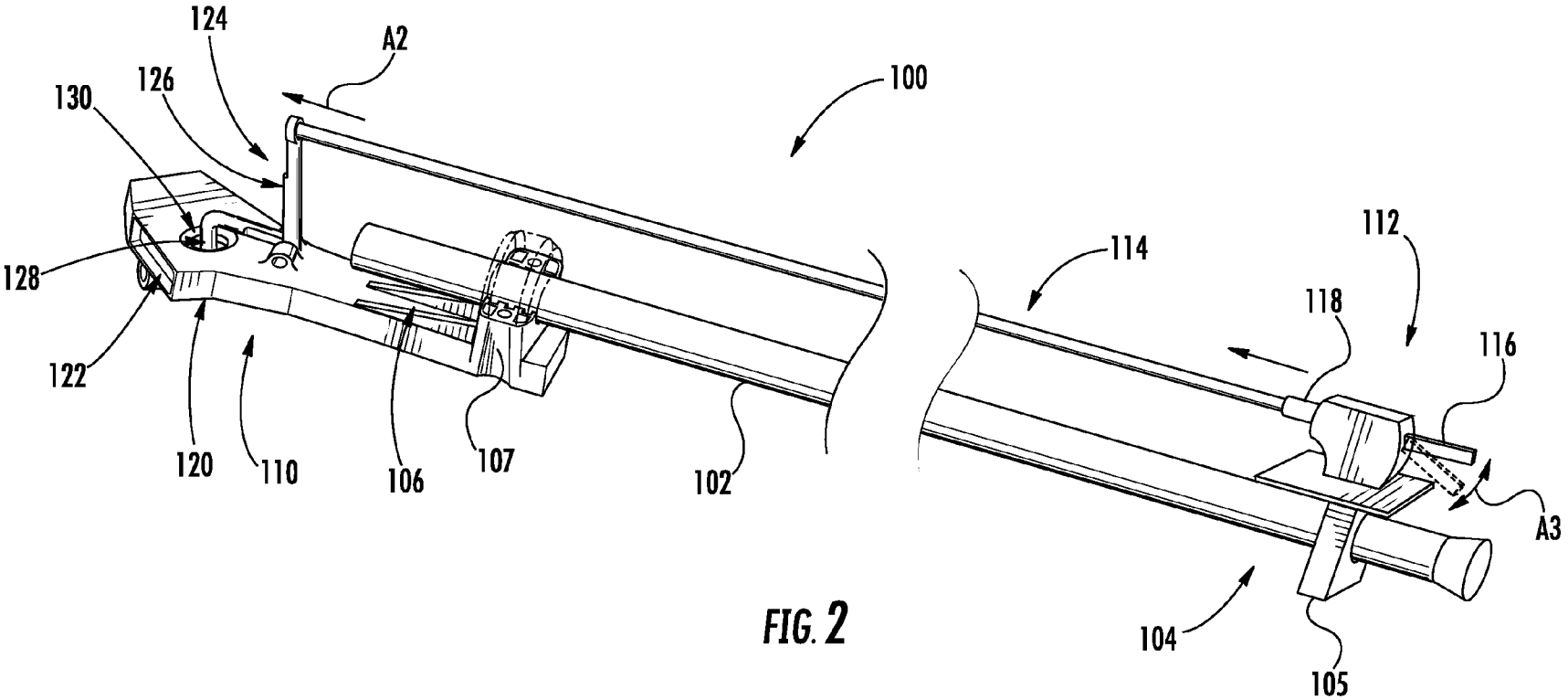
FIG. 2 is a perspective view of an apparatus for locking out a bus plug according to some embodiments of the invention.

Embodiments of the present invention allow an operator to lockout the bus plug at or near ground level. An apparatus 100 for locking out a bus plug is illustrated in FIG. 2. The apparatus 100 includes a first elongated insulated member 102 such as a hot stick. The first elongated member 102 may have a length of between about 6 and 20 feet or more. In some embodiments, the first elongated member 102 has a length of at least about 10 feet.

The first elongated member 102 has opposite proximal and distal end portions 104, 106. A lockout device 110 is attached or connected to the distal end portion 106. A clamp 107 or the like may be used to attach or connect the lockout device 110 to the first elongated member 102.

An actuator device 112 is attached or connected to the proximal end portion 104 of the first elongated member 102. A clamp 105 or the like may be used to attach or connect the actuator device 112 to the first elongated member 102.

A second elongated member 114 extends between the lockout device 110 and the actuator device 112. The second elongated member 114 may be generally parallel to the first elongated member 102. The second elongated member 114 may be formed of a suitable insulating material such as fiberglass. The second elongated member 114 may have a length that is about the same as the length of the first elongated member 102.

The lockout device 110 includes a body or housing 120. A handle receiving feature such as a first channel 122 is defined in the body 120. The lockout device 110 includes a handle engagement mechanism, e.g., a pin assembly 124 that is pivotally attached or connected to the body 120. The pin assembly 124 includes a lever member 126 and a pin member 128.

The second elongated member 114 is attached or connected to the lever member 126. The lever member 126 moves in the direction indicated by the arrow A2 in response to actuation of the actuator device 112. For example, the actuator device 112 may include an actuator 116 that is rotatable in the direction shown by the arrow A3 to translate a plunger 118 which in turn urges the second elongated member 114 in the direction A2. An exemplary actuator device 112 is a toggle clamp, although one skilled in the art will understand that any suitable actuating device that translates the second elongated member 114 in the direction A2 may be employed.

The pin member 128 extends through an aperture 130 in the body 120 and into the first channel 122 in response to movement of the lever member 126 in the direction A2.

Figure 3:
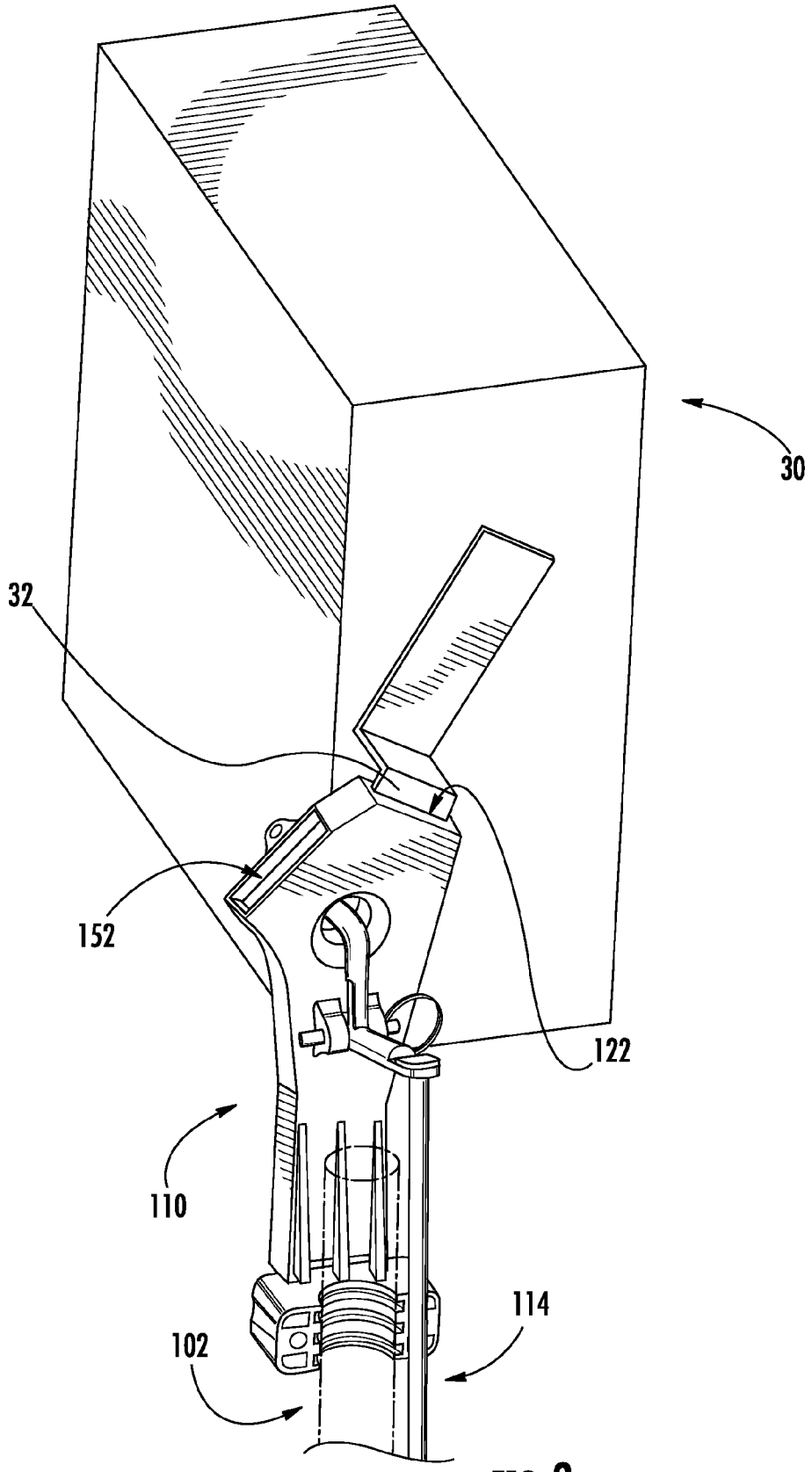
FIG. 3 is a side perspective view of a lockout device of the apparatus of FIG. 2 with a bus plug handle received in the lockout device.

Turning now to FIG. 3, the first channel 122 is sized and configured to receive the handle 32 of the bus plug 30. For example, the handle 32 in the "off" position may be received in the first channel 122 as shown in FIG. 3.

Figure 4:
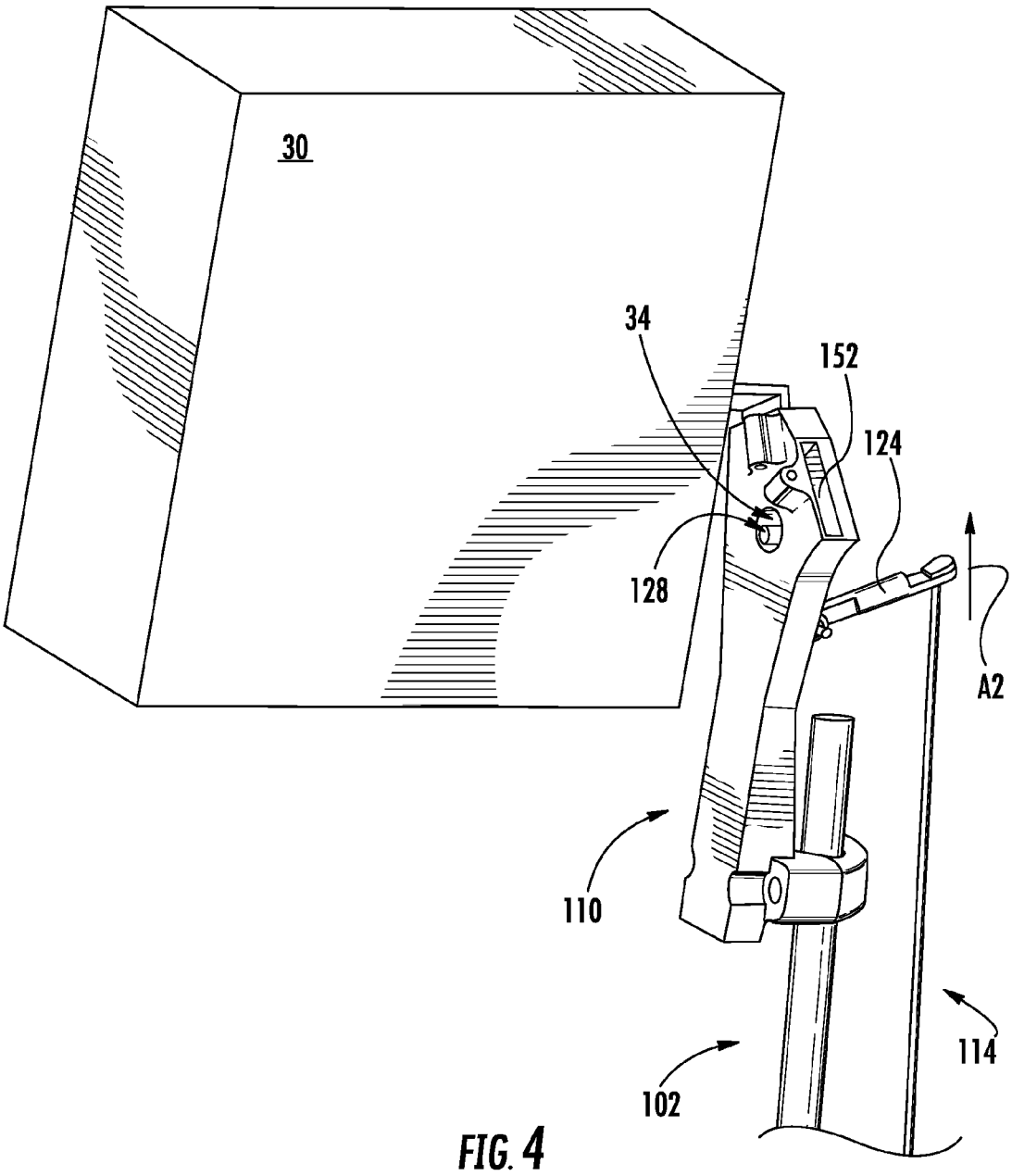
FIG. 4 is a front perspective view of a lockout device of the apparatus of FIG. 2 engaged with a bus plug handle.

Referring now to FIG. 4, with the movement of the second elongated member 114 and the corresponding movement of the lever member 124 in the direction A2 as described above, the pin member 128 extends into the first channel 122 (FIG. 3) and through the bus plug handle aperture 34. In this position, the lockout device 110 is engaged or lockingly engaged with the handle 32.

Figure 5:
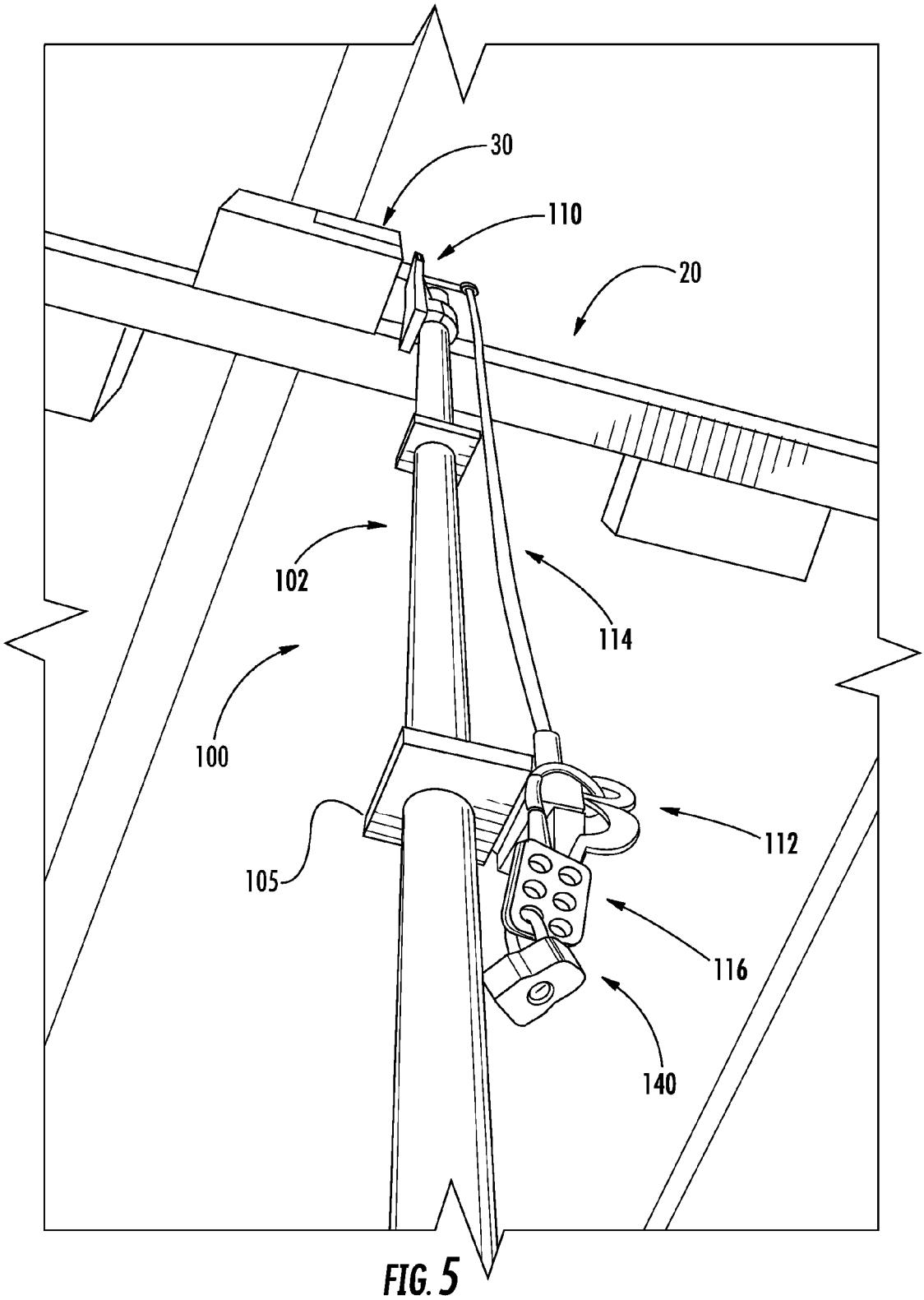
FIG. 5 is a bottom perspective illustrating a bus plug that is locked out using the apparatus of FIG. 2.

Turning now to FIG. 5, with the lockout device lockingly engaged with the bus plug handle, an operator on the ground can lockout the disconnected bus plug 30. As illustrated in FIG. 5, a locking mechanism such as a lock 140 can be connected to the actuator device 112 and/or the actuator 116 to lock the actuator device 112 and/or the actuator 116. For example, the lock 140 may lock the actuator 116 to the clamp 105 such that the actuator 116 stays in place. One skilled in the art will appreciate that other locking mechanisms may be employed; for example, the locking mechanism may be integrated with the actuator device 112.

The apparatus 100 may have a length such that the actuator device 112 is near ground level, e.g., at waist or shoulder level, such that an operator can lockout the bus plug 30 while on the ground. The apparatus 100 may remain suspended from the bus plug 30 while the bus plug 30 is locked out.

When the equipment attached to the busway 20 is to be re-energized, the locking mechanism, e.g., the lock 140, is unlocked and the actuating device 112 is actuated such that the lockout device 110 is no longer lockingly engaged with the bus plug handle 32. For example, the actuator 116 may be actuated in an opposite direction than as described above such that the second elongated member 114 moves in a direction opposite the direction A2 (FIG. 2). The operator may then remove the apparatus 100 and take it to another job or to storage.

Referring again to FIGS. 3 and 4, the lockout device 110 may include a second channel 152. The second channel 152 may be sized and configured to receive different brands and/or sizes of bus plug handle(s) than the first channel 122. For example, the second channel 152 may be deeper and/or wider than the first channel 122. The second channel 152 may be positioned such that the pin member 128 extends therethrough in response to the actuator device 112 in the way described above.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the teachings and advantages of this invention. Accordingly, all such modifications are intended to be included within the scope of this invention as defined in the claims. The invention is defined by the following claims, with equivalents of the claims to be included therein.

That which is claimed is:

1. An apparatus for locking out an elevated bus plug, the apparatus comprising:
- an elongated member;
- a lockout device at a distal end portion of the elongated member, the lockout device comprising:
  - a housing;
  - a channel in the housing that is sized and configured to releasably receive a handle of the bus plug; and
  - a handle engagement mechanism connected to the housing; and
- an actuator at a proximal end portion of the elongated member, wherein the handle engagement mechanism is configured to engage a handle of the bus plug that has been received in the channel so that the handle is lockingly held in the channel responsive to actuation of the actuator.

2. The apparatus of claim 1 wherein the handle of the bus plug is an elongated handle positioned on an exterior of the bus plug.

3. The apparatus of claim 1 wherein the elongated member is a first elongated member, the apparatus further comprising a second elongated member that extends between the actuator and the handle engagement mechanism.

4. The apparatus of claim 3 wherein:
- the handle engagement member is pivotally connected to the housing and comprises a lever member and a pin member;
- the second elongated member is connected to the lever member; and
- the pin member extends through the channel and through an aperture of a handle of the bus plug that has been received in the channel responsive to actuation of the actuator.

5. The apparatus of claim 1 wherein the channel is a first channel, the lockout device further comprising a second channel that is differently sized than the first channel and is configured to receive a handle of the bus plug, and wherein the handle engagement mechanism is configured to engage a handle of the bus plug that has been received in the second channel responsive to actuation of the actuator.

6. The apparatus of claim 5 wherein the lockout device comprises an aperture defined in the body housing, wherein the aperture is positioned such that the handle engagement mechanism extends through the aperture and through the first channel and the second channel responsive to actuation of the actuator.

7. The apparatus of claim 1 further comprising a locking mechanism at the proximal end portion of the elongated member, the locking mechanism configured to lock the actuator.

8. The apparatus of claim 7 wherein the locking mechanism is configured to lock the actuator such that the handle engagement member remains engaged with a handle of the bus plug that has been received in the channel.

9. The apparatus of claim 7 wherein the apparatus has a length such that the actuator and/or the locking mechanism are about 5 feet or less off the ground when the handle engagement member is engaged with a handle of the bus plug that is about 12 feet or more off the ground.

10. The apparatus of claim 1 wherein the elongated member is an electrically insulating elongated member.

11. The apparatus of claim 10 wherein the elongated member is a hot stick.

12. The apparatus of claim 10 wherein the elongated member has a length of at least about 10 feet.

13. An apparatus for locking out an elevated bus plug, the apparatus comprising:

a lockout device comprising:

a housing;

a channel in the housing that is sized and configured to releasably receive a handle of the bus plug; and a handle engagement mechanism connected to the housing;

wherein the lockout device is configured to connect to a distal end portion of an elongated electrically insulating member; and wherein the handle engagement mechanism is configured to engage a handle of the bus plug that has been received in the channel so that the handle is lockingly held in the channel responsive to actuation of an actuator at a proximal end portion of the elongated electrically insulating member.

14. The apparatus of claim 13 wherein:

the handle engagement member is pivotally connected to the housing and comprises a lever member and a pin member; and the pin member extends through the channel and through an aperture of a handle of the bus plug that has been received in the channel responsive to actuation of the actuator.

15. The apparatus of claim 13 wherein the handle engagement member is configured to lockingly engage a handle of the bus plug that has been received in the channel responsive to a locking mechanism at the proximal end portion of the elongated electrically insulating member.

16. The apparatus of claim 13 wherein the channel is a first channel, the lockout device further comprising a second channel that is differently sized than the first channel and is configured to receive a handle of the bus plug, and wherein the handle engagement mechanism is configured to engage a handle of the bus plug that has been received in the second channel responsive to actuation of the actuator.

17. The apparatus of claim 16 wherein the lockout device comprises an aperture defined in the housing, wherein the aperture is positioned such that the handle engagement mechanism extends through the aperture and through the first channel and the second channel responsive to actuation of the actuator.

18. A method for locking out an elevated bus plug, the method comprising:

providing an apparatus comprising:

an elongated member;

a lockout device at a distal end of the elongated member, the lockout device comprising a housing, a handle receiving channel in the housing and a handle engagement member; and an actuator at a proximal end of the elongated member;

releasably receiving a handle of the bus plug in the channel; and lockingly engaging and holding the handle in the channel with the handle engagement member responsive to actuation of the actuator.

19. The method of claim 18 further comprising locking the actuator after engaging the handle to lockout the bus plug.

20. The method of claim 18 wherein the elongated member has a length of at least about 10 feet.

* * * * *